US006970084B2

(12) United States Patent
Kwon

(10) Patent No.: US 6,970,084 B2
(45) Date of Patent: Nov. 29, 2005

(54) ALARM GENERATING DOOR LOCK

(76) Inventor: Oh Sung Kwon, Rm. 302 Yongma Villa 337-5 Kil-dong, Kangdong-gu, Seoul (KR)

( * ) Notice: Subject to any disclaimer, the term of this patent is extended or adjusted under 35 U.S.C. 154(b) by 124 days.

(21) Appl. No.: 10/656,770

(22) Filed: Sep. 4, 2003

(65) Prior Publication Data

US 2004/0046659 A1 Mar. 11, 2004

(30) Foreign Application Priority Data

Sep. 6, 2002 (KR) ..... 20-2002-0026815

(51) Int. Cl.[7] ..... E05B 45/06
(52) U.S. Cl. ..... 340/542; 340/543; 70/91; 70/116
(58) Field of Search ..... 340/542, 545.1, 340/545.3, 545.6, 545.7; 70/91, 116

(56) References Cited

U.S. PATENT DOCUMENTS 4,360,803 A * 11/1982 Heiland ..... 340/542
4,970,494 A * 11/1990 Keely et al. ..... 340/567
5,311,168 A * 5/1994 Pease, Jr. et al. ..... 340/542
5,754,107 A * 5/1998 Ferrantelli ..... 340/542
6,020,816 A * 2/2000 Agozzino ..... 340/542
6,812,836 B2 * 11/2004 Soloway et al. ..... 340/542

* cited by examiner

*Primary Examiner*—Toan N. Pham
(74) *Attorney, Agent, or Firm*—Frommer Lawrence & Haug LLP; Ronald R. Santucci

(57) ABSTRACT

A door lock includes a body, a locking device installed in part of the body to lock and unlock an entrance door and having a first handle provided at an inner side of the entrance door, a lock assembly engaged with the first handle when a normal key is inserted, and a locking member actuated by rotation of the first handle, a first sensing device which becomes an ON state as the locking member protrudes outside the locking device and an OFF state as the protruded locking member retreats, a speaker generating alarm when the first sensing device senses an intruder, and a power portion supplying electric power to the first sensing device and the speaker, wherein holes, through which the first handle and part of the first sensing device are exposed, are formed at an outer surface of the body, a cover is provided at a portion corresponding to the power portion, and the speaker is installed on the body so that sound is emitted out of the body.

14 Claims, 7 Drawing Sheets

ALARM GENERATING DOOR LOCK

This application claims the priority of Korean Patent Application No. 2002-26815 filed on 6 Sep. 2002 in the Korean Intellectual Property Office, the disclosure of which is incorporated herein in its entirety by reference.

BACKGROUND OF THE INVENTION

1. Field of the Invention

The present invention relates to a door lock, and more particularly, to a door lock which generates alarm when an unauthorized entering happens regardless of opening of a door.

2. Description of the Related Art

A locking device consisting of a lock and a key has long been used. A locking device using a password, in which a predetermined series of numbers are set by turning a dial for unlocking, has widely been used.

As an unauthorized unlocking method with respect to these locking devices are becoming known, various locking devices preventing such an unauthorized unlocking has been suggested. For example, a computer key, a finger print recognizing system, and a card key have been introduced. The locking devices are not only used for a personal saving and in a variety of places such as offices and banks, but also for a locking device of an entrance door in private houses.

These locking devices are superior in performance because only a person who knows a password or has a card key can unlock the door. However, the locking devices are useless when an intruder breaks a door where the locking device is installed.

SUMMARY OF THE INVENTION

To solve the above and other problems, the present invention provides an alarm generating door lock which can notify existence of an intruder to the outside when an entrance door is abnormally unlocked or broken.

According to an aspect of the present invention, a door lock comprising: a body: a locking device installed in part of the body to lock and unlock an entrance door and having a first handle provided at an inner side of the entrance door, a lock assembly engaged with the first handle when a normal key is inserted, and a locking member actuated by rotation of the first handle; a first sensing device which becomes an ON state as the locking member protrudes outside the locking device and an OFF state as the protruded locking member retreats; a speaker generating alarm when the first sensing device senses an intruder; and a power portion supplying electric power to the first sensing device and the speaker, wherein holes, through which the first handle and part of the first sensing device are exposed, are formed at an outer surface of the body, a cover is provided at a portion corresponding to the power portion, and the speaker is installed on the body so that sound is emitted out of the body.

In the locking device, the locking member penetrates the body to protrude in a selected direction of three directions of the body by rotation of the first handle.

The first sensing device comprises a sensing portion which senses heat and an infrared ray radiated from an intruder and a movement of the intruder.

A remote controller having a through hole through which the locking member passes is installed at a side of the body where the locking member protrudes, the remote controller being in an ON state when the locking member passes through and remaining in the through hole and in an OFF state when the locking member does not exist in the through hole, in an opposite manner to that of the first sensing portion.

At least one of a second sensing device and an alarm light apparatus operated by the remote controller is provided at a place remote from the remote controller.

The second sensing device is provided at least one of a ceiling of the entrance door, a wall surface facing the entrance door, and a place facing a window.

An alarm light portion generating alarming light when the second sensing device senses an intruder is provided in the second sensing device.

A tact switch is provided at an inner side of the lock assembly where a key is inserted so that alarm is generated when a foreign material, not the key, is inserted and contacts the tact switch, and one of power lines connected to the tact switch is connected to the speaker via the locking device.

The door lock further comprises a switch turning on and off the first sensing device and provided on the first sensing device.

According to another aspect of the present invention, a door lock comprising: a body: a locking device installed in part of the body to lock and unlock an entrance door and having a first handle provided at an inner side of the entrance door, a lock assembly provided at an outer side of the entrance door and engaged with the first handle when a normal key is inserted, and a locking member actuated by rotation of the first handle; a remote controller which becomes an ON state as the locking member protrudes outside the locking device and an OFF state as the protruded locking member retreats; a speaker generating alarm when a foreign material, not a key, is inserted in the lock assembly; a power portion supplying electric power to the remote controller and the speaker; and a sensing device provided at a place remote from the remote controller and operated by the remote controller, wherein holes, through which the first handle and part of the first sensing device are exposed, are formed at an outer surface of the body, a cover is provided at a portion corresponding to the power portion, and the speaker is installed on the body so that sound is dissipated out of the body.

The door lock further comprises an alarm light apparatus provided at a place remote from the remote controller and operated by the remote controller.

The body further comprises a main handle used to open and shut the entrance door.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

Figure 1:
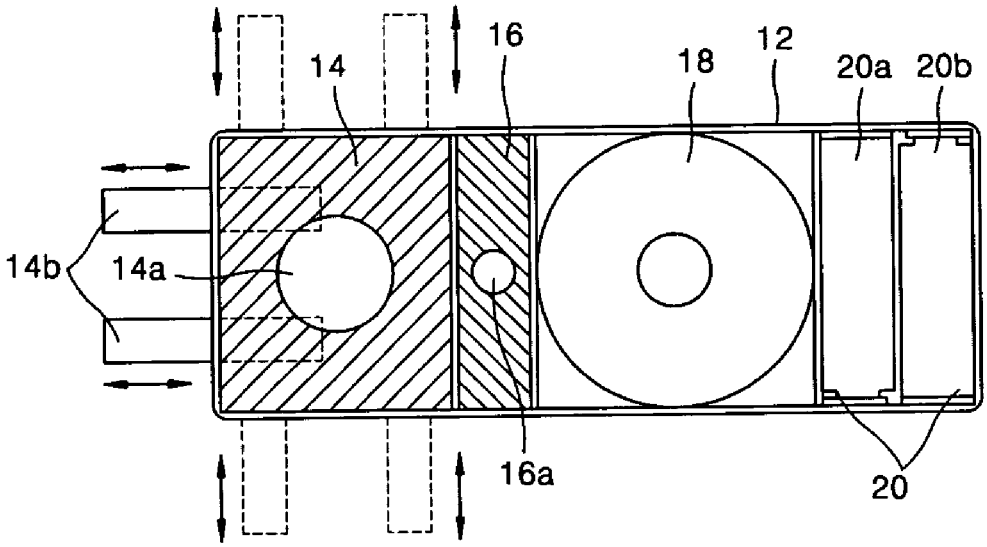
FIG. 1 is a plan view illustrating a door lock having an alarm generating function according to a first preferred embodiment of the present invention.
Figure 2:
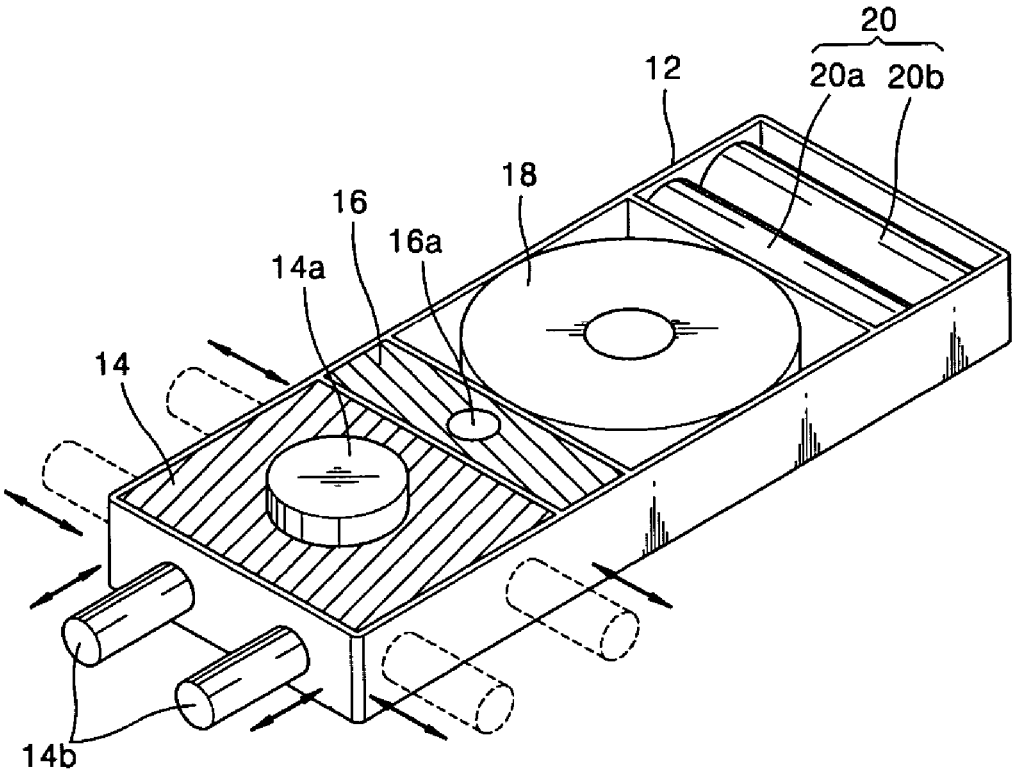
FIG. 2 is a perspective view illustrating the door lock of FIG. 1.

Referring to FIGS. 1 and 2, an door lock 10 according to a first preferred embodiment of the present invention (hereinafter, referred to as the first door lock) includes a body 12 and various members installed thereon. A locking device 14 is provided at the inner left side of the body 12. A power portion 20 where batteries 20*a* and 20*b* are installed is provided at the inner right side of the body 12. A first sensing device 16 and an alarming unit, for example, a speaker 18, are sequentially installed from the left side between the locking device 14 and the power portion 20.

The body 12 can be configured in the following two ways.

Figure 3:
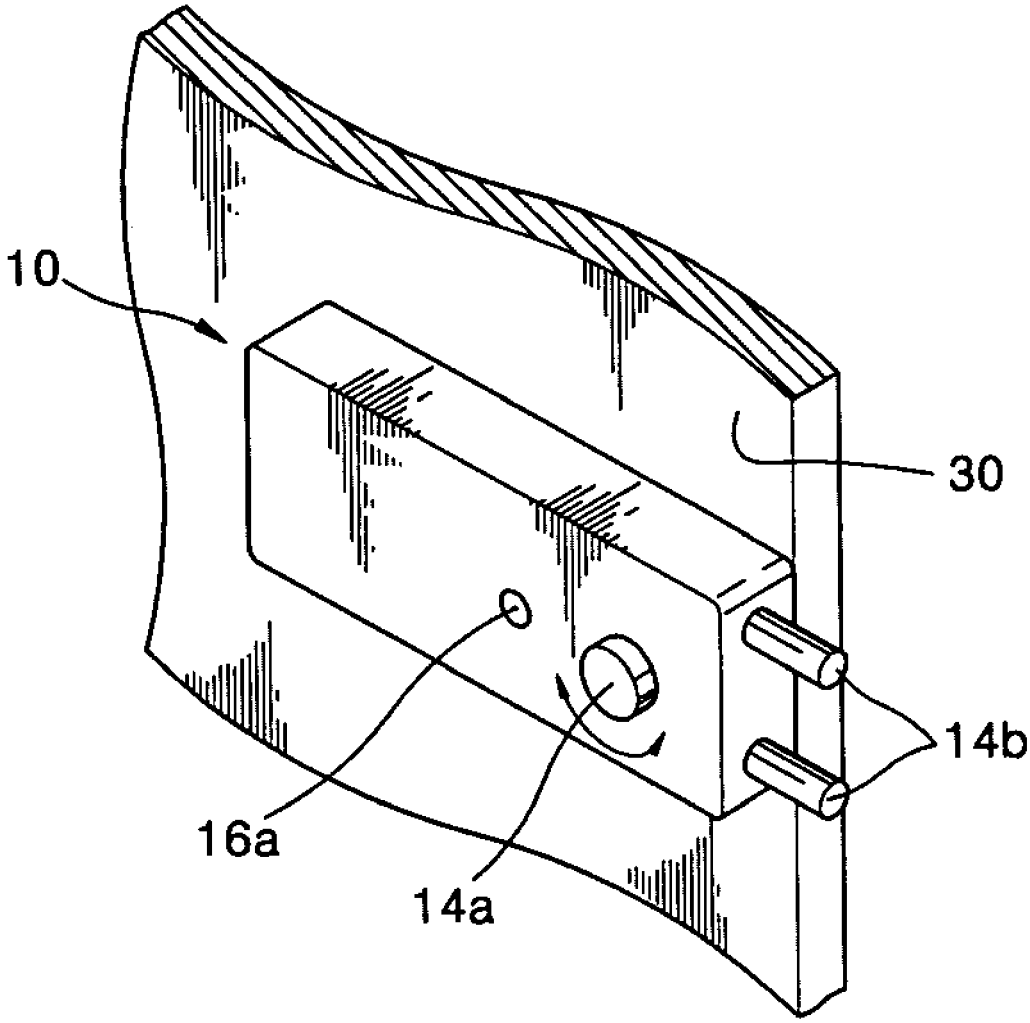
FIG. 3 is a perspective view illustrating the door lock of FIG. 1 installed horizontally with respect to the door.
Figure 4:
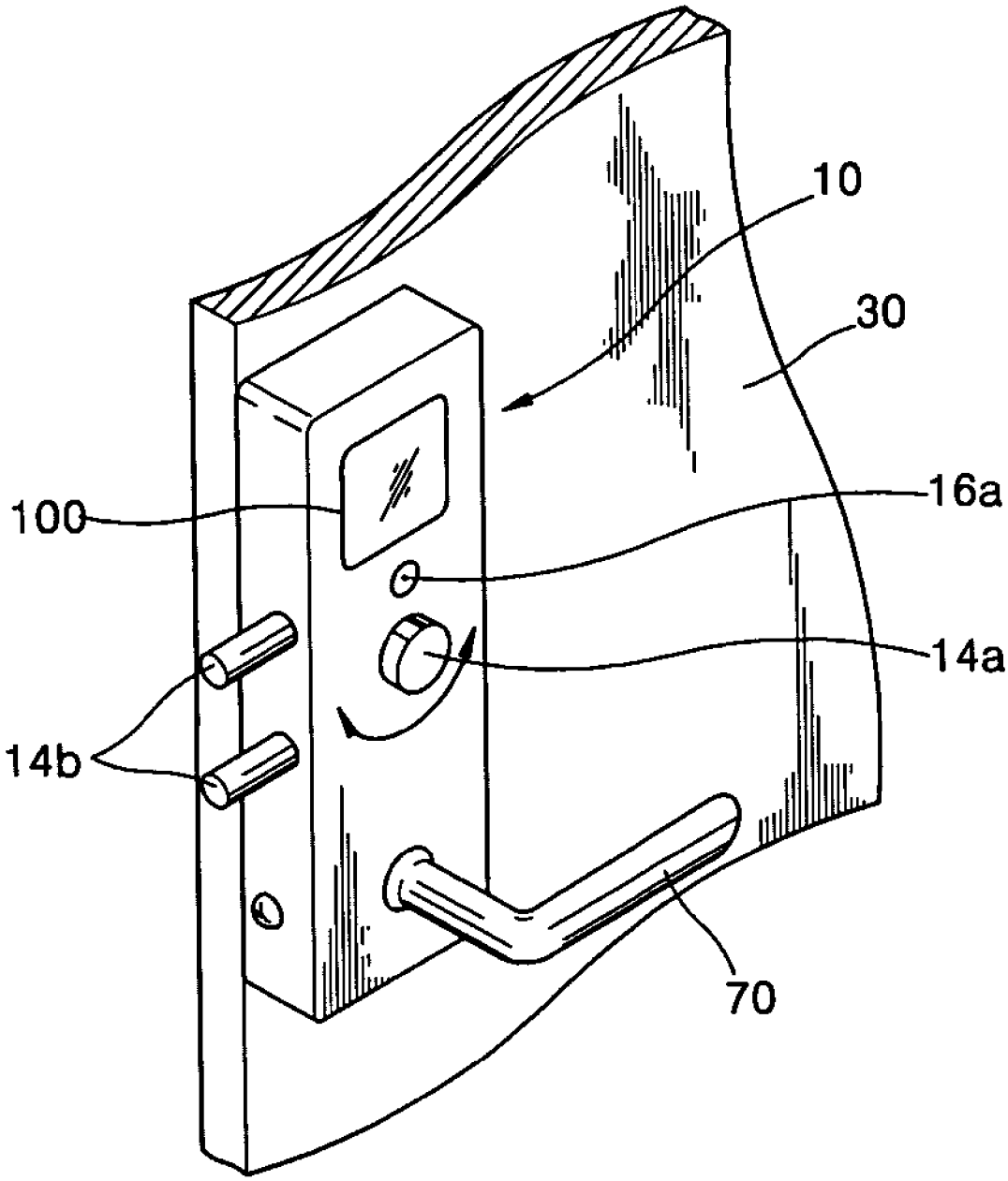
FIG. 4 is a perspective view illustrating the door lock of FIG. 1 installed vertically with respect to the door.
Figure 5:
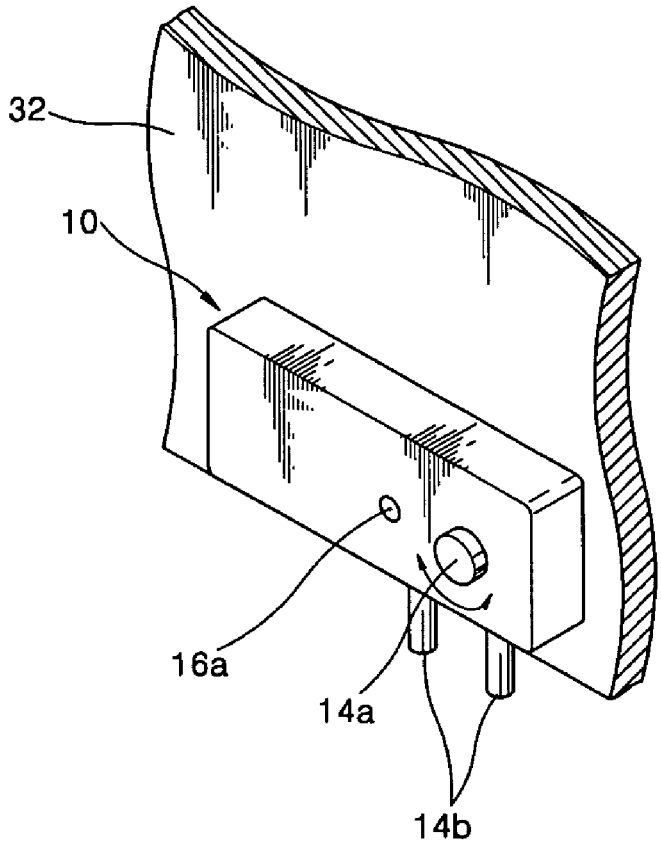
FIG. 5 is a perspective view illustrating the door lock of FIG. 1 installed at the lower end of the door.

First, when the first door lock 10 is installed on an entrance door 30 as shown in FIGS. 3 through 5, a surface on which a first handle 14*a*, that is, the outside of the body 12 as shown in FIG. 1, is exposed may be covered by a cover (not shown). Holes for portions to be exposed, such as the first handle 14*a* and a first sensing portion 16*a*, are formed in the cover. The first sensing portion 16*a* senses an infrared ray generated by an external thing, for example, an intruder. The power portion 20 has a cover (not shown) to facilitate replacement of batteries when the first door lock 10 is installed on the entrance door 30.

Second, the body 12 is integrally formed except for the side which contacts the entrance door 30 unlike the body shown in FIG. 1. The side of the body 12 contacting the entrance door 30 is removed so that constituent elements can be installed on the body 12 through this side. Holes for portions to be exposed outwardly, including the first handle 14*a*, are formed on the outer side of the body 12. In this case, a cover to facilitate replacement of batteries after the first door lock 10 is installed on the entrance door 30 is provided to the power portion 20.

In addition, a light emitting portion (not shown) is provided on a surface of the first sensing device 16 to outwardly indicate the operation of the first sensing device 16 or the consumption of power. The light emitting portion can be exposed outwardly through the cover or the outer surface of the body that is integrally formed.

The locking device 14 has the first handle 14*a* and a locking member 14*b*. The locking member 14*b* protrudes toward a hole formed in a frame of the entrance door 30 by penetrating the body 12 from the inside of the locking device 14 to the outside, or comes back from the frame of the entrance door 30, as the first handle 14*a* is rotated. Although two locking members are shown in the drawing, one locking member or two or more locking members can be provided. The locking member 14*b* protrudes to penetrate the body 12 in a lengthwise direction of the first door lock 10 as shown in FIG. 1. However, as indicated by imaginary lines in FIGS. 1 and 2, the locking member 14*b* may protrude toward upper or lower side of the body 12. The direction in which the locking member 14*b* protrudes is determined considering the position of the first door lock 10 installed on the entrance door 30. For example, as shown in FIG. 3 or 5, when the first door lock 10 is horizontally installed on the entrance door 30, the locking member 14*b* protrudes in the lengthwise direction of the first door lock 10 as shown in FIG. 1. When the first door lock 10 is vertically installed on the entrance door 30 as shown in FIG. 4, the locking member 14*b* protrudes in a direction perpendicular to the lengthwise direction of the first door lock 10 as indicated by imaginary lines of FIG. 1.

As shown in FIG. 4, a second handle 70 may further be provided at the first door lock 10 as a main handle used to open and shut the entrance door 30. For example, referring to FIG. 1, a portion where the locking device 14 of the body 12 is provided can be extended and the second handle 70 can be installed at the extended portion. The second handle 70 is installed in a horizontal direction with respect to the entrance door 30 as shown in FIG. 4 so as to be rotated downward. The second handle 70 can be deformed in a variety of forms and can be applied in a second preferred embodiment which will be described later. In FIG. 4, reference numeral 100 denotes a cover used to replace the batteries of the power portion 20 of FIG. 1.

The first sensing device 16 includes a circuit board (not shown) to control a sensing operation and the first sensing portion 16*a* and is operated by being engaged with the locking device 14. The first sensing portion 16*a* is connected by the speaker 18 through the circuit board. When the first door lock 10 is locked by rotating the first handle 14*a*, the first sensing device 16 is in an "ON" state. When the first door lock 10 is unlocked as the first handle 14*a* is rotated in the opposite direction, the first sensing device 16 is in an "OFF" state.

The ON/OFF state of the first sensing device 16 each can be of two steps. For example, an on/off switch (not shown) is separately provided at a portion of the first sensing device 16, for example, at the upper or lower portion of the first sensing portion 16*a*. After the on/off switch is turned on, the first door lock 10 is locked by rotating the first handle 14*a* so that the first sensing device 16 is in the "ON" state. When the first handle 14*a* is rotated in the opposite direction to unlock the first door lock 10, the on/off switch is turned off so that the first sensing device 16 is in the "OFF" state.

In the operation of the first door lock 10, when the first door lock 10 is installed at the entrance door 30 or 32 as shown in FIGS. 3 through 5, and an intruder removes the locking state in an abnormal manner or breaks the entrance door 30 or 32 itself, since the first door lock 10 is still in the "ON" state although the entrance door 30 or 32 is entirely broken in the latter case, the first sensing device 16 is in the "ON" state. Accordingly, an infrared ray radiated from the intruder is received by the first sensing portion 16*a* of the first sensing device 16. The first sensing device 16 senses the infrared ray and outputs alarm via the speaker 18.

Figure 6:
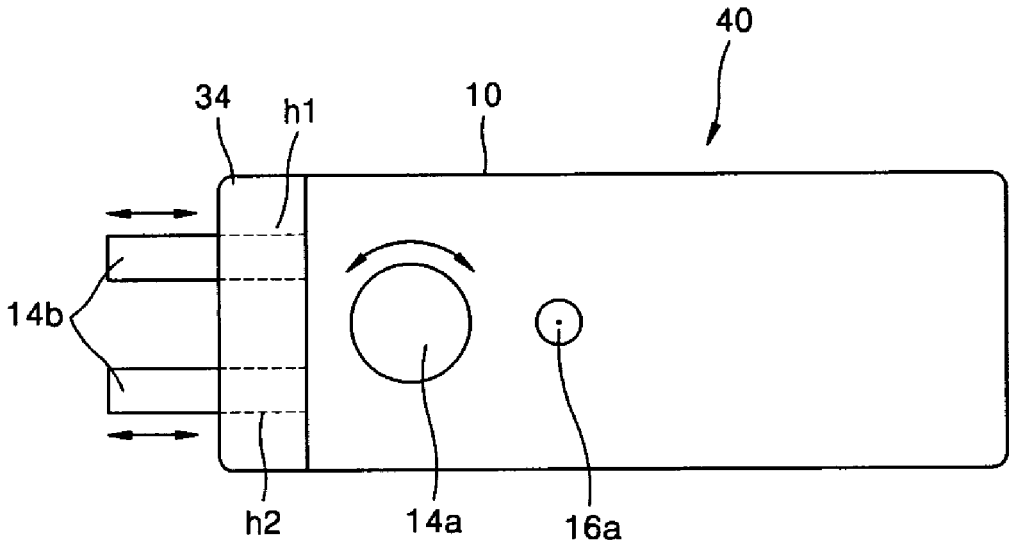
FIG. 6 is a plan view illustrating a door lock having an alarm generating function according to a second preferred embodiment of the present invention.

Referring to FIG. 6, an door lock 40 according to a second preferred embodiment of the present invention (hereinafter, referred to as the second door lock) includes the first door lock 10 and a remote control member 34 attached to the first door lock 10 (hereinafter, referred to as the remote controller). The remote controller 34 is operated according to the operation of the locking device 14, that is, protrusion of the locking member 14*b*. For example, when the locking member 14*b* protrudes to penetrate first and second through holes h1 and h2 and is kept therein, the remote controller 34 is in the "ON" state. When the locking member 14*b* comes back to the inside of the locking device 14 so as not to be present in the first and second through holes h1 and h2, the remote controller 34 is in the OFF state. The remote controller 34 controls the operation of a device installed at a place remote from the second door lock 40.

Figure 7:
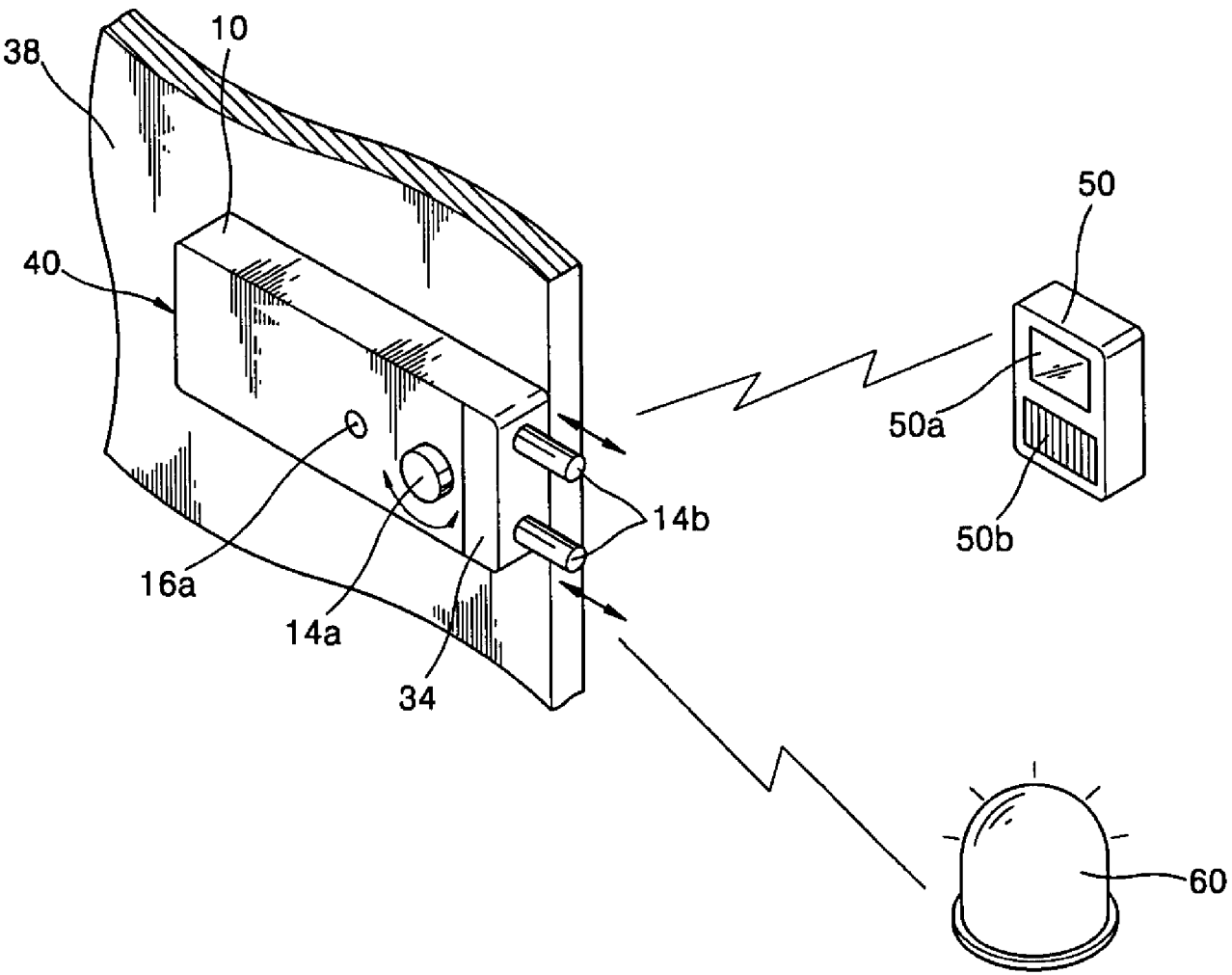
FIG. 7 is a view showing an alarming system including the door lock of FIG. 6 installed on an entrance door and alarm generating members separately disposed.

For example, as shown in FIG. 7, in the state in which the second door lock 40 is installed on an entrance door 36, the remote controller 34 controls the operation of a second sensing device 50 having the same function as that of the first sensing device 16 and/or an alarm light apparatus 60 to notify the presence of an intruder, which are located at a place remote from the entrance door 36. The second sensing device 50 includes a second sensing portion 50*a* receiving an infrared ray radiated from an intruder and an alarm generating portion 50*b* to notify the sense of an intruder. The second sensing device 50 may be installed at a ceiling near the entrance door, a wall facing the entrance door, or a portion facing a window. The alarm light apparatus 60 can be provided in an inner room which can be easily viewed from the outside through a window or at the outer portion of the window. By providing the second sensing device 50 and/or the alarm light apparatus 60, an alarm system is established. An alarm light portion having the same function as that of the alarm light apparatus 60 can be provided at the second sensing device 50.

Since the second sensing device 50 or an equivalent sensing apparatus is provided at a ceiling near the entrance door or a place facing the entrance door or a window, when an intruder is not sensed or the intruder intrudes through the window while the intruder unlocks the entrance door in an abnormal manner or completely breaks the entrance door itself, the intrusion of the intruder can be notified.

As shown in FIG. 6, the remote controller 34 is installed at a portion where the locking member 14*b* of the first door lock 10 protrudes. However, the remote controller 34 can be provided at the place where the first sensing device 16 of FIG. 1 is installed.

In the former case, the second sensing device 50 and/or the alarm light apparatus 60 are used together with the first sensing device 16. In the latter case, the second sensing device 50 and/or the alarm light apparatus 60 are used alone. Also, in the former case, a process in which the remote controller 34 is turned on/off is the opposite to a process in which the first sensing device 16 is turned on/off.

In the case of the first sensing device 16, the "ON" state occurs when the locking member 14*b* protrudes so that the locking member 14*b* does not exist in the locking device 14. In contrast, in the case of the remote controller 34, the "ON" state occurs when the locking member 14*b* exists in the locking device 14. The "OFF" state occurs in the reverse case.

Figure 8:
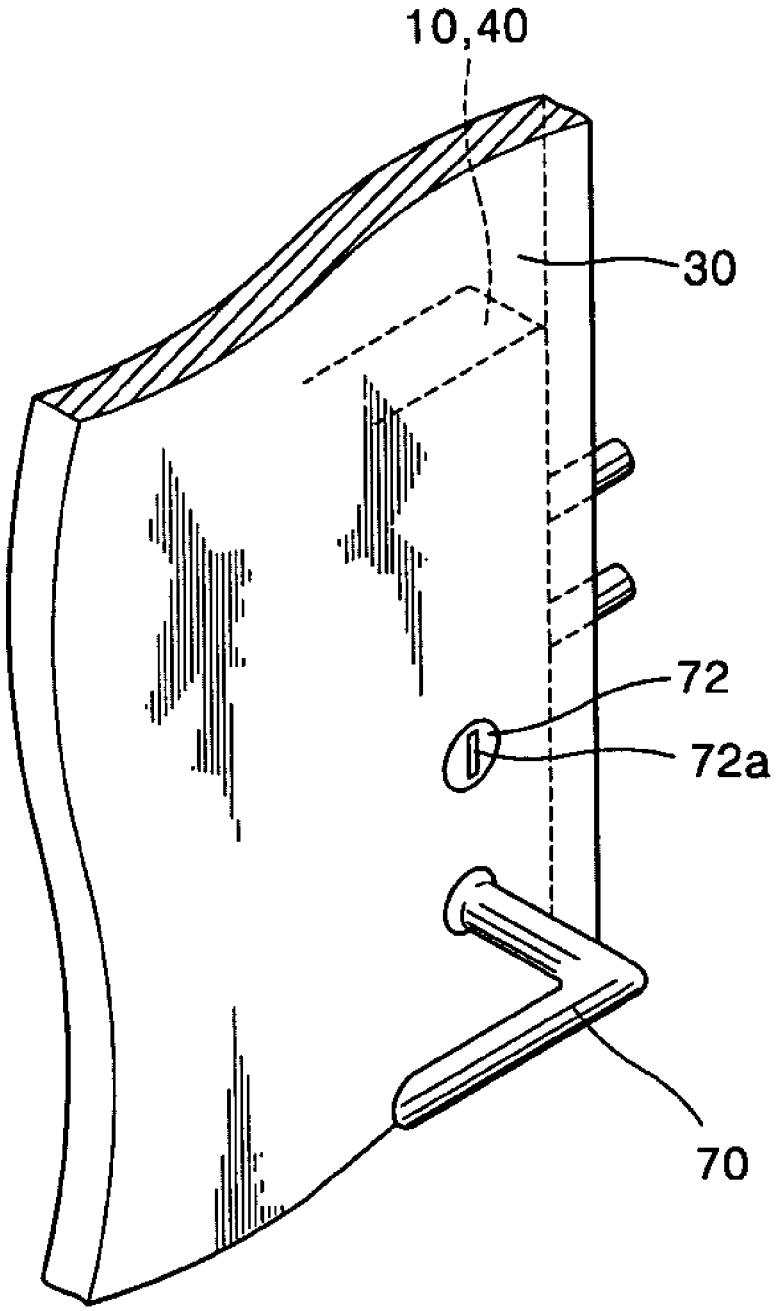
FIG. 8 is a perspective view illustrating a rear side of the entrance door where the door lock having an alarm generating function according to the first or second preferred embodiments according to the present invention is installed.

FIG. 8 shows the outer side of the entrance door 30 where the first or second door locks 10 or 40 is installed.

Referring to FIG. 8, the second handle 70 which is used by a user to open the entrance door 30 is provided and a lock assembly 72 having an insertion hole 72*a* in which a key is inserted is provided above the second handle 70. When a normal key is inserted in the insertion hole 72*a*, the lock assembly is engaged with the first handle 14*a* of the first or second door lock 10 or 40.

Figure 9:
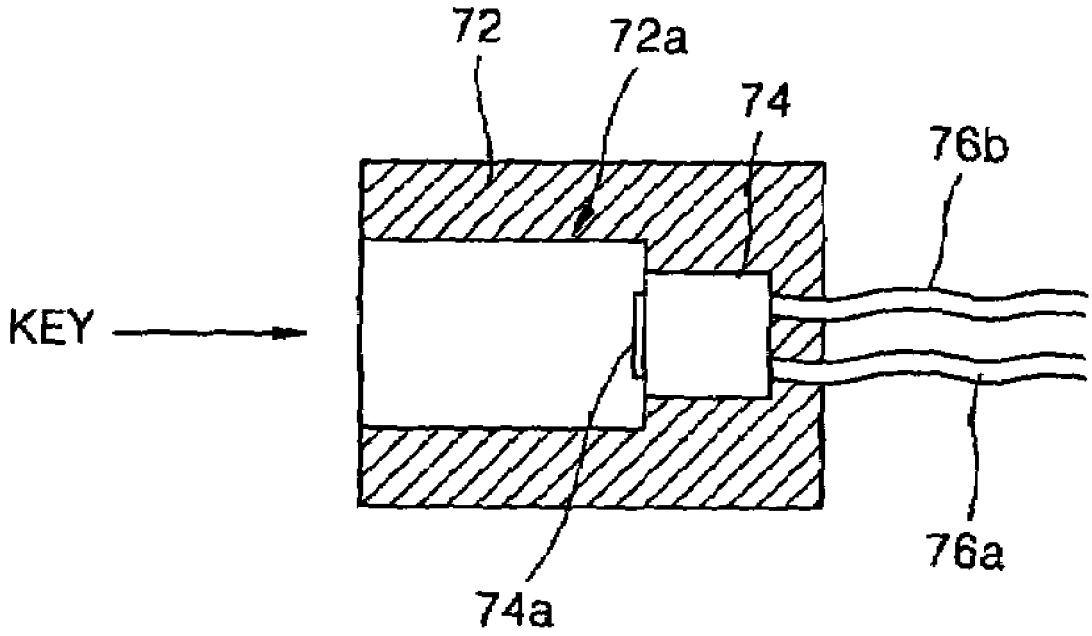
FIG. 9 is a sectional view illustrating the inside of a key insertion hole of the door lock having an alarm generating function according to the first and second preferred embodiments according to the present invention.

FIG. 9 shows the structure of the lock assembly 72. Referring to FIG. 9, insertion hole 72*a* is formed inside the lock assembly 72 to a predetermined depth. A tact switch 74 is provided at the innermost side of the insertion hole 72*a*. When an abnormal key, that is a foreign material such as a chopstick or an iron stick, is inserted and contacts the tact switch 74, alarm is generated.

The tact switch 74 is connected to the speaker 18 through the circuit board of the first sensing device 16. Reference numeral 74*a* denotes a button provided on the tact switch 74 and contacting the foreign material. First and second power supply likes 76*a* and 76*b* are connected to the tact switch 74. Power is supplied to the tact switch 74 through the first and second power supply lines 76*a* and 76*b*. When the button 74*a* is pressed, current flows via the tact switch 74 to generate an alarm. To the contrary, when the button 74*a* is not pressed, the current flowing via the tact switch 74 may be cut off.

One of the first and second power supply lines 76*a* and 76*b* is connected by a fine switch (not shown) provided on the locking device 14 of the first and/or second door locks 10 and 40. Accordingly, when an intruder unlocks the door lock using a foreign material, the tact switch 74 functions as a hindrance to the intrusion. When the intruder breaks the entrance door itself, the first and/or second sensing devices 16 and 50 function as a hindrance to the intrusion. Thus, intrusion cannot succeed without being sensed.

As described above, the door lock according to the present invention includes an integrated sensing apparatus which can sense heat, an infrared ray, or movement generated from an intruder. An equivalent sensing apparatus is provided at a ceiling near an entrance door or a place facing the entrance door or a window. Thus, when an intruder unlocks the locking device by using a foreign material or breaks the entrance door itself, the intrusion is immediately notified through alarm so that the intrusion is prevented or made difficult.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A door lock comprising:

a body:

a locking device installed in part of the body to lock and unlock an entrance door and having a first handle provided at first side of the entrance door, a lock assembly engaged with the first handle when a normal key is inserted, and a locking member actuated by rotation of the first handle;

a first sensing device which becomes an ON state as the locking member protrudes outside the locking device and an OFF state as the protruded locking member retreats;

a speaker generating alarm when the first sensing device senses an intruder;

a power portion supplying electric power to the first sensing device and the speaker, wherein holes, through which the first handle and part of the first sensing device are exposed, are formed at an outer surface of the body, a cover is provided at a portion corresponding to the power portion, and the speaker is installed on the body so that sound is emitted out of the body; and a tact switch on a first side of the lock assembly wherein an alarm is generated when a foreign material other than a normal key is inserted into an insertion hole and wherein a power line connected to the tact switch is connected to the speaker via the locking device.

2. The door lock as claimed in claim 1, wherein, in the locking device, the locking member penetrates the body to protrude in a selected direction of three directions of the body by rotation of the first handle.

3. The door lock as claimed in claim 1, wherein the first sensing device comprises a sensing portion which senses heat and an infrared ray radiated from an intruder and a movement of the intruder, and the sensing portion is exposed through a hole formed in an outer surface of the body.

4. The door lock as claimed in claim 3, further comprising a switch turning on and off the first sensing device and provided on the first sensing device.

5. The door lock as claimed in claim 4, wherein the body further comprises a main handle used to open and shut the entrance door.

6. The door lock as claimed in claim 1, wherein a remote controller having a through hole through which the locking member passes is installed at a side of the body where the locking member protrudes, the remote controller being in an ON state when the locking member passes through and remaining in the through hole and in an OFF state when the locking member does not exist in the through hole, in an opposite manner to that of the first sensing portion.

7. The door lock as claimed in claim 6, wherein at least one of a second sensing device and an alarm light apparatus operated by the remote controller is provided at a place remote from the remote controller.

8. The door lock as claimed in claim 7, wherein the second sensing device is provided at least one of a ceiling of the entrance door, a wall surface facing the entrance door, and a place facing a window.

9. The door lock as claimed in claim 8, wherein an alarm light portion generating alarming light when the second sensing device senses an intruder is provided in the second sensing device.

10. The door lock as claimed in claim 6, wherein the body further comprises a main handle used to open and shut the entrance door.

11. The door lock as claimed in claim 1, wherein the body further comprises a main handle used to open and shut the entrance door.

12. A door lock comprising:

a body:

a locking device installed in part of the body to lock and unlock an entrance door and having a first handle provided at first side of the entrance door, a lock assembly provided at second side of the entrance door and engaged with the first handle when a normal key is inserted, and a locking member actuated by rotation of the first handle;

a remote controller which becomes an ON state as the locking member protrudes outside the locking device and an OFF state as the protruded locking member retreats;

a speaker generating alarm when a foreign material, not a key, is inserted in the lock assembly, wherein the lock assembly comprises a tact switch for activating the alarm;

a power portion supplying electric power to the remote controller and the speaker; and a sensing device provided at a place remote from the remote controller and operated by the remote controller, wherein holes, through which the first handle and part of the first sensing device are exposed, are formed at an outer surface of the body, a cover is provided at a portion corresponding to the power portion, and the speaker is installed on the body so that sound is dissipated out of the body.

13. The door lock as claimed in claim 12, further comprising an alarm light apparatus provided at a place remote from the remote controller and operated by the remote controller.

14. The door lock as claimed in claim 12, wherein the body further comprises a main handle used to open and shut the entrance door.

* * * * *